US005285039A

United States Patent [19]

Satoh

[11] Patent Number: 5,285,039

[45] Date of Patent: Feb. 8, 1994

[54] SEESAW TYPE SWITCH

[75] Inventor: Yukihiko Satoh, Furukawa, Japan

[73] Assignee: Alps Electric Co., Ltd., Tokyo, Japan

[21] Appl. No.: 942,693

[22] Filed: Sep. 9, 1992

[30] Foreign Application Priority Data

Sep. 18, 1991 [JP] Japan ..... 3-083270[U]

[51] Int. Cl.[5] ..... H01H 15/02

[52] U.S. Cl. ..... 200/563; 200/561; 200/339

[58] Field of Search ..... 200/563, 562, 561, 557, 200/558, 553, 339, 302.3, 332, 547, 548, 549, 550, 551, 556, 5 A

[56] References Cited

U.S. PATENT DOCUMENTS

| | | | |
|---|---|---|---|
| 2,808,482 | 10/1957 | Zanichkowsky et al. | 200/553 X |
| 3,591,747 | 7/1971 | Dennison | 200/557 |
| 3,746,809 | 7/1973 | Gaber | 200/436 |
| 4,169,972 | 10/1979 | Black et al. | 200/561 X |
| 4,367,379 | 1/1983 | Tomé | 200/556 X |
| 4,697,053 | 9/1987 | Lockard | 200/339 X |
| 4,808,778 | 2/1989 | Fujiyoshi | 200/339 |
| 5,158,172 | 10/1992 | Roeser et al. | 200/553 |
| 5,213,204 | 5/1993 | Somme | 200/553 X |

FOREIGN PATENT DOCUMENTS

| | | | |
|---|---|---|---|
| 1555986 | 1/1969 | France | 200/557 |

*Primary Examiner*—Henry J. Recla
*Assistant Examiner*—Glenn T. Barrett
*Attorney, Agent, or Firm*—Guy W. Shoup; Patrick T. Bever

[57] ABSTRACT

A seesaw type switch having a first lever pivotably mounted to a case, and a second lever pivotably mounted over the first lever such that a protruding portion of the second lever abuts a top surface of the first lever. A protruding portion of the first lever positions a slider relative to a stationary contact connected to the case. The first lever is pivoted by manual actuation of a knob connected to the second lever.

8 Claims, 6 Drawing Sheets

SEESAW TYPE SWITCH

FIELD OF THE INVENTION

The present invention relates to a seesaw type switch in which breaking and making of contacts are selectively changed over with seesaw movement of a lever.

DESCRIPTION OF THE RELATED ARTS

FIGS. 6 through 8 are explanatory views of the prior art; in which FIG. 6 is a perspective view of a power window switch unit, FIG. 7 is an explanatory view of a toggle switch built in the unit, and FIG. 8 is an explanatory view of a seesaw type switch built in the unit.

As shown in FIG. 6, a power window switch unit 1 has three toggle switches 2 for opening and closing windows associated with respective seats of a motor vehicle, and a seesaw type switch 3 for controlling on/off operations of those three toggle switches 2. Principal actuating portions of the four switches 2, 3 are housed in a single case 4 and a cover 5. From the design standpoint of the unit, a knobs 2*a* of the toggle switches 2 are arranged on the same plane as the surface of the cover 5, but only a knob 3*a* of the seesaw type switch 3 is arranged at a one-step higher level, i.e., over a projecting portion 5*a* provided on the cover 5.

As shown in FIG. 7, each toggle switch 2 has a lever 7 having opposite shafts 8 which are rotatably supported by a flanged portion 6 provided on the cover 5. A torsion coil spring 10 is wound around a projection 9 of the lever 7 in such a manner that a pair of its resilient arms 10*a*, 10*b* extends in opposite relation to the cover 5 while gradually getting toward the upper surface of the cover 5. Denoted by 11 is a cover fitted with the case 4 to enclose the lower open surface of the case 4 with an insulating board 12 held in the case 4.

The lever 7 is extended downward while penetrating through a hole 13 of the case 4, and has a bulged portion 14 at its lower end engaged in a hole 15*a* of a slider 15 which is slidably arranged on the insulating board 12. Inside the slider 15, there is housed a movable contact 17 capable of moving into or out of contact with a stationary contact 16 on the insulating board 12. Note that 30 is a connector.

On the other hand, as shown in FIG. 8, the seesaw type switch 3 has a lever 18 having opposite shafts 20 which are rotatably supported by a flanged portion 19 provided on the projecting portion 5*a* of the cover 5. As with the toggle switch 2, the lever 18 is also extended downward while penetrating through another corresponding hole 13 of the case 4, and has a bulged portion 14 at its lower end engaged in a hole 15*a* of another corresponding slider 15 which is slidably arranged on the insulating board 12. Inside the slider 15, there is similarly housed a movable contact 17 capable of moving into or out of contact with a stationary contact 16 on the insulating board 12.

The toggle switch 2 of the power window switch unit 1 thus constructed is vertically positioned in a rest state of the knob 2*a* fixed to the upper end of the lever 7. By turning the knob 2*a* clockwise, for example, the bulged portion 14 of the lever 7 engaging the slider 15 is moved to the left over the insulating board 12. Upon the knob 2*a* being released from the depressing force exerted on the same, the resilient force of the torsion coil spring 10 causes the toggle switch 2 to restore to the original rest state. During this movement, the movable contact 17 is contacted with or separated from the stationary contact 16 for selective breaking or making of the contacts.

Further, the seesaw type switch 3 is inclined clockwise with the knob 3*a* lowered at its right end and the bulged portion 21 displaced to the left, as shown in FIG. 8, in a rest state of the knob 3*a* fixed to the upper end of the lever 18. By depressing the left end of the knob 3*a* in that state, the bulged portion 21 of the lever 18 engaging the slider 15 is moved to the right over the insulating board 12. During this movement, the movable contact 17 is contacted with or separated from the stationary contact 16 for selective breaking or making of the contacts.

In the above-explained unit, however, the distance $t_2$ from the insulating board 12 to a support point of the lever 18 of the seesaw type switch 3, i.e., the central axis of the shaft 20, is set to be larger than the distance $t_1$ from the insulating board 12 to a support point of the lever 7 of other each toggle switch 2, i.e., the central axis of the shaft 8. Accordingly, the amount of movement of the slider 15 is increased with respect to an angle of inclination of the lever 18 so as to make the area occupied by the seesaw type switch 3 greater than the other area, which eventually leads to the problem that a reduction in the entire configuration of the power window switch unit 1 is prevented.

SUMMARY OF THE INVENTION

With a view of solving the problem as mentioned above, an object of the present invention is to reduce the distance through which a slider is moved by a lever upon its seesaw motion even when the distance from an insulating board to a support point of the lever is set to be relatively large, thereby making the entire switch size smaller.

The above object is achieved by a seesaw type switch of the present invention comprising an insulating board having a stationary contact, a slider having a movable contact, a first lever rotatably supported by a case and engaging said slider, and a second lever rotatably supported by a cover fitted with said case, wherein a driver rod is held by said second lever through a coil spring, said driver rod being slidable over the top surface of said first lever.

With the seesaw type switch of the present invention, a lever is divided into the first lever and the second lever, and the first lever engaging the slider is rotatably supported by the case. Therefore, even when the height of the cover is increased to increase the distance between a support point of the second lever and the insulating board, the sliding distance of the slider is minimized, thereby minimizing the size of the seesaw type switch.

DETAILED DESCRIPTION OF THE PREFERRED EMBODIMENT

Figure 1:
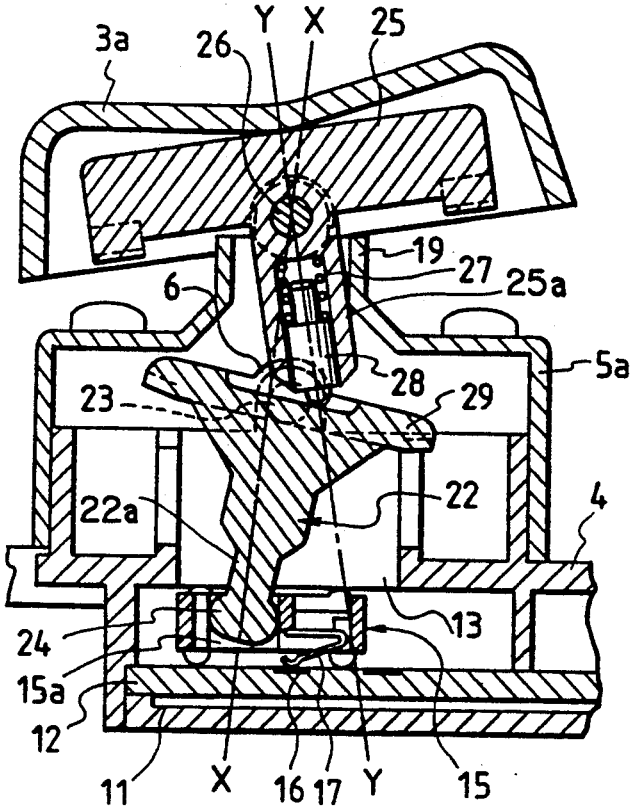
FIG. 1 is a view for explaining operation of a seesaw type switch of the present invention in a state where a switch knob is inclined in one direction.
Figure 2:
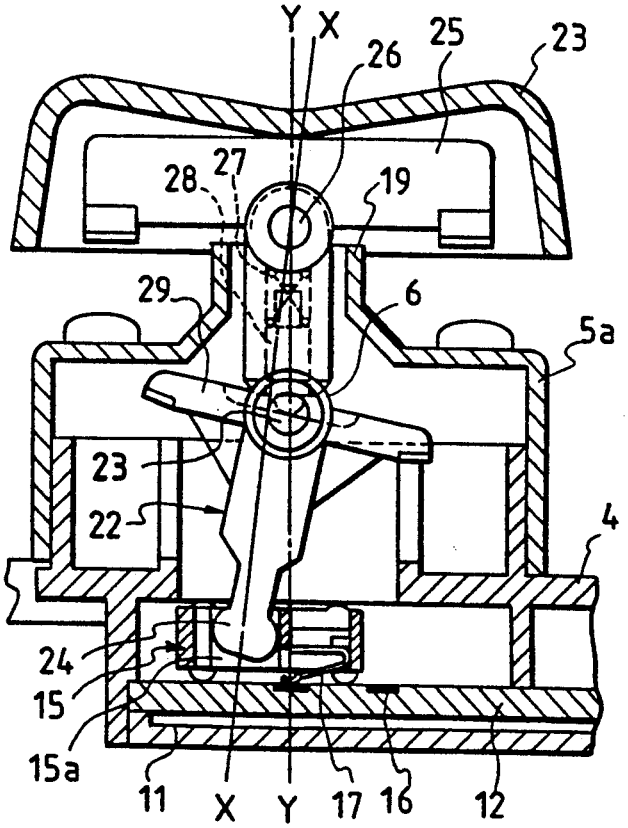
FIG. 2 is a view for explaining operation of the seesaw type switch of the present invention in a state during change-over.
Figure 3:
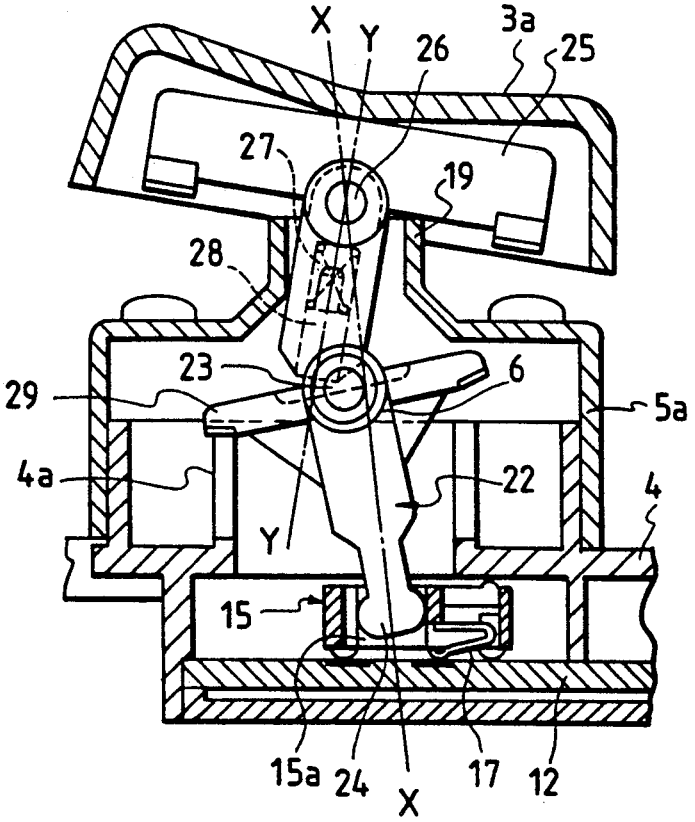
FIG. 3 is a view for explaining operation of the seesaw type switch of the present invention in a state after it has been changed over with the switch knob inclined in the other direction.
Figure 4:
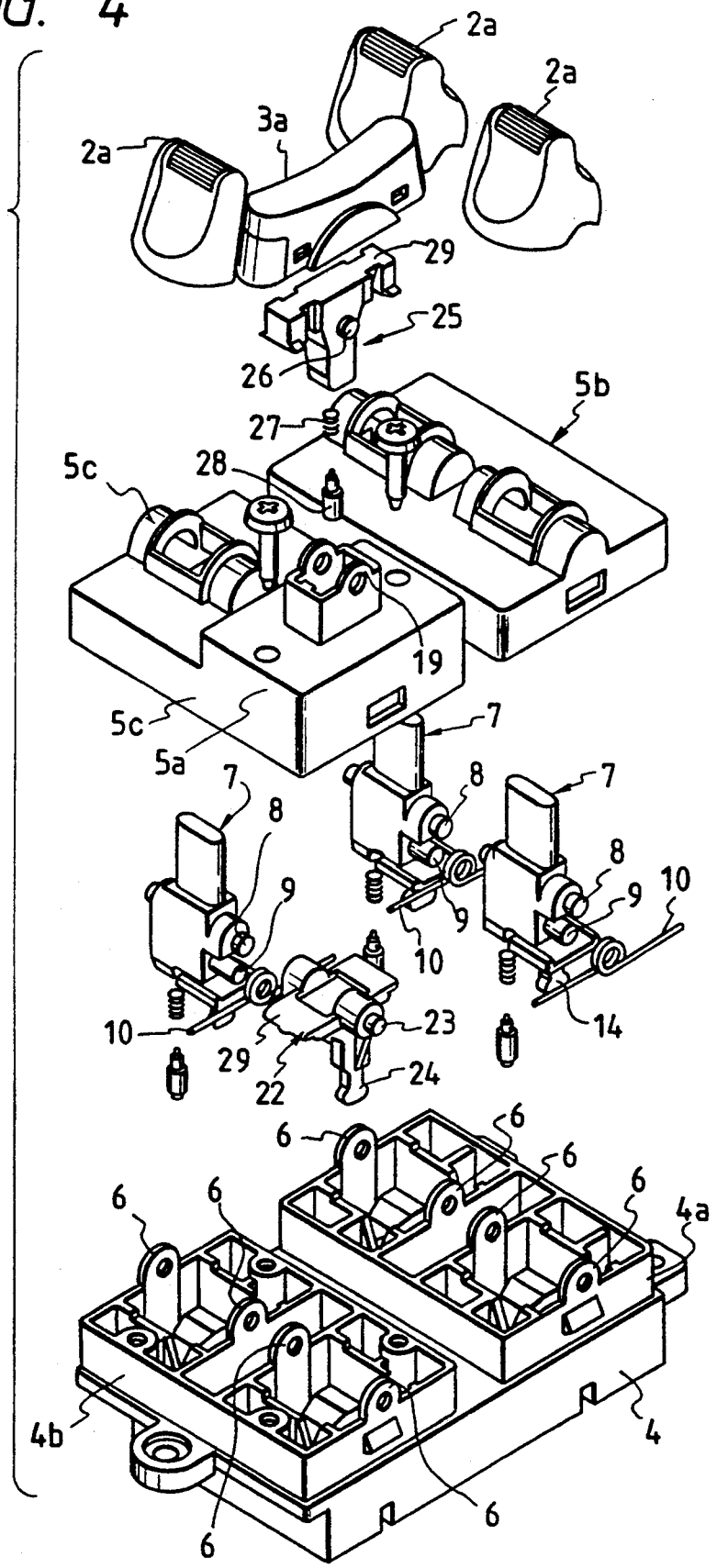
FIG. 4 is an exploded perspective view mainly showing parts of a cover, a lever and a case of a power window switch unit in which the seesaw type switch of the present invention is built.
Figure 5:
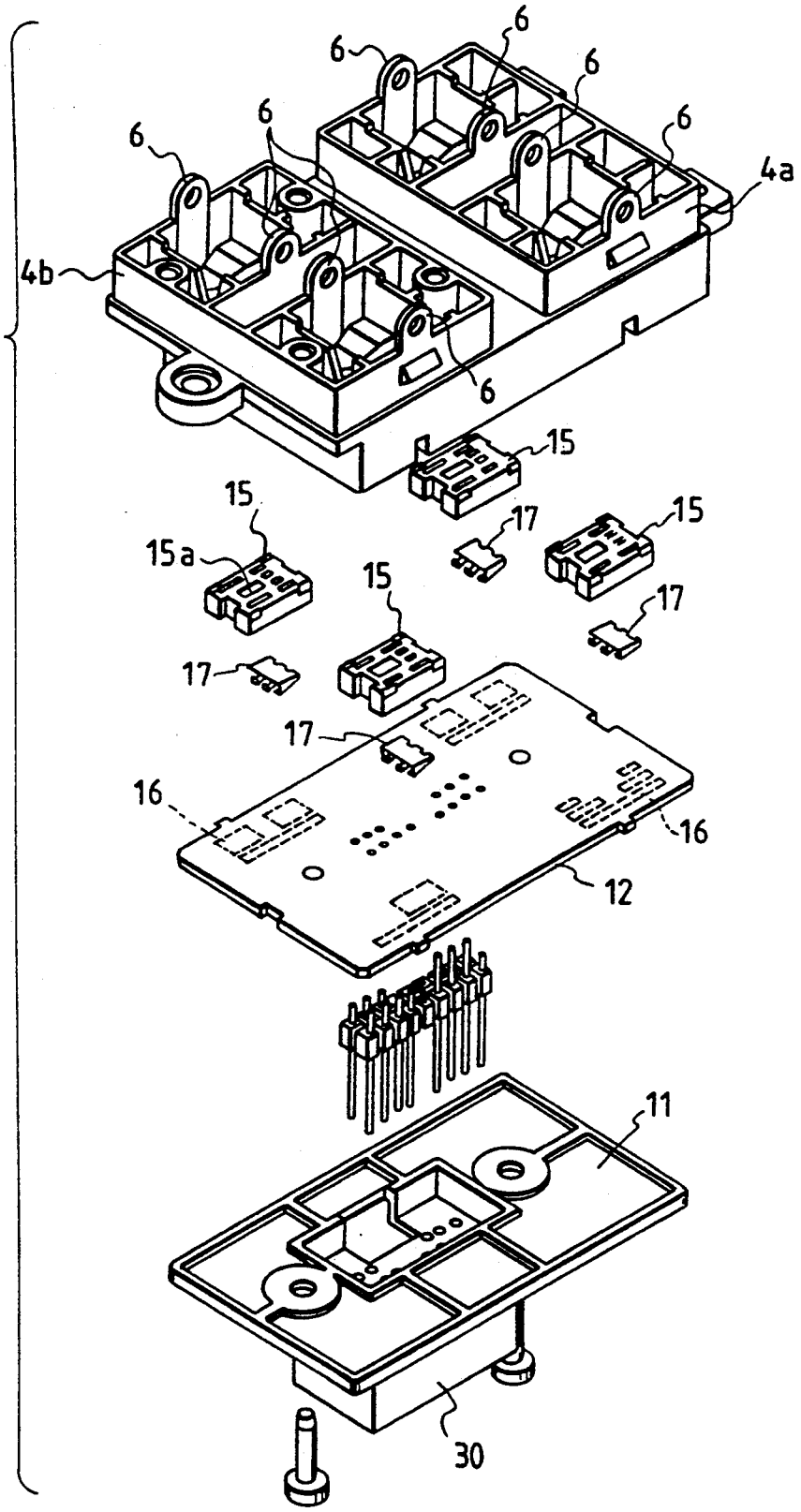
FIG. 5 is an exploded perspective view mainly showing parts of the case, a slider, and an insulating board of the power window switch unit in which the seesaw type switch of the present invention is built.
Figure 6:
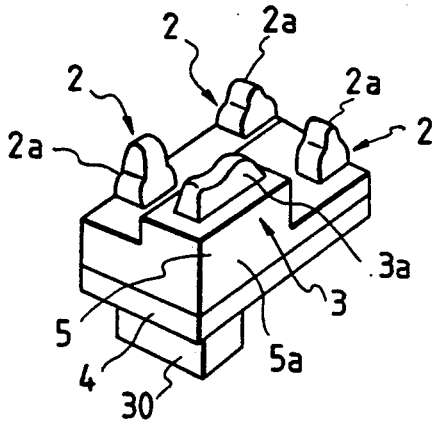
FIG. 6 PRIOR ART
FIG. 6 is a perspective view of a power window switch unit of the prior art.
Figure 7:
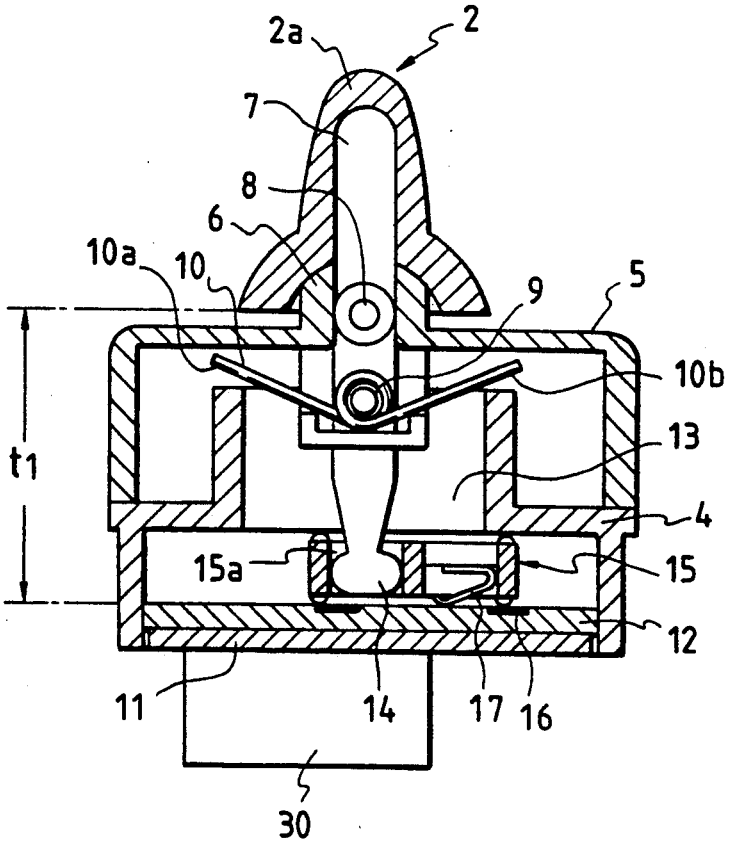
FIG. 7 PRIOR ART
FIG. 7 is an explanatory view of a toggle switch built in the power window switch unit of the prior art.
Figure 8:
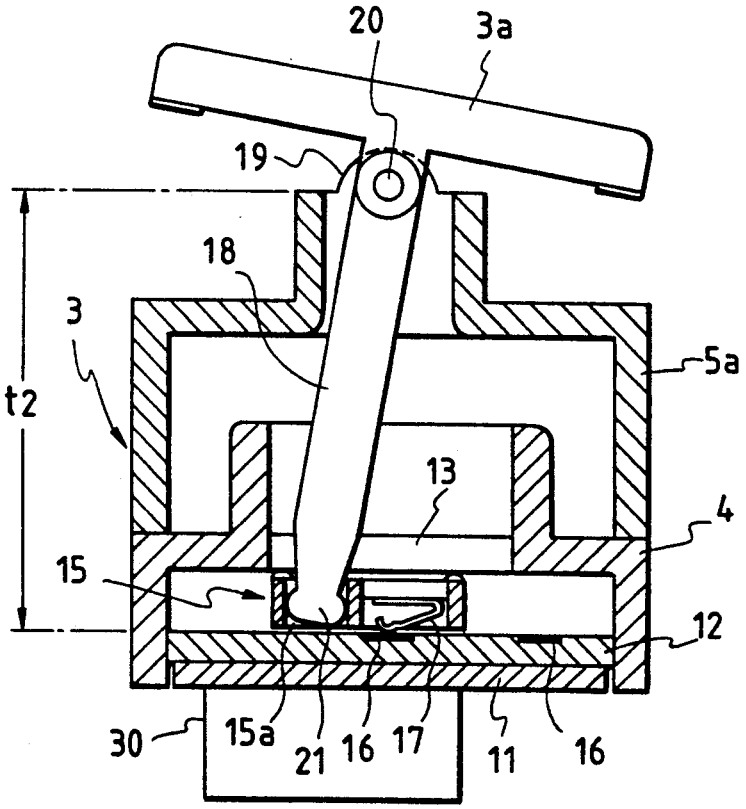
FIG. 8 PRIOR ART
FIG. 8 is an explanatory view of a seesaw type switch built in the power window switch unit of the prior art.

Hereinafter, one preferred embodiment of the present invention will be described with reference to the drawings (FIGS. 1 through 5). In the attached drawings, FIG. 1 is a view for explaining operation of a seesaw type switch in a state where a switch knob is inclined in one direction, FIG. 2 is a view for explaining operation of the seesaw type switch in a state during change-over, FIG. 3 is a view for explaining operation of the seesaw type switch in a state after it has been changed over, and further FIGS. 4 and 5 are each an exploded perspective view of a power window switch unit in which the seesaw type switch of the present invention is incorporated. It is to be noted that the same parts in these figures as those in the prior art shown in FIGS. 6 through 8 are denoted by the same reference numerals.

Referring to FIG. 1, denoted by 22 is a first lever having opposite shafts 23 which are rotatably supported by a flanged portion 6 (see FIG. 4) provided on a case 4. The lever 22 includes a (first) protruding portion 22*a* extending downward while penetrating through a hole 13 of the case 4, and has a bulged portion 24 at its lower end engaged in a hole 15*a* of a slider 15 which is slidably arranged on an insulating board 12. Inside the slider 15, there is housed a movable contact 17 capable of moving into or out of contact with a stationary contact 16 on the insulating board 12. Denoted by 25 is a second lever having opposite shafts23 which are rotatably supported by a flanged portion 19 provided on a projecting portion 5*a* of a cover 5. The second lever 25 includes a (second) protruding portion 25*a* having a hollow inner portion. A coil spring 27 and a drive rod 28 are disposed in the hollow inner portion in such a manner that the driver rod 28 is biased against and slidable over the top surface of a horizontal portion 29 of the first lever 22. It will be understood that, as shown in FIG. 4, each toggle switch 2 has a lever 7 of which opposite shafts 8 are rotatably supported by another pair of flanged portions 6 of the case 4, and has a bulged portion 14 at its lower end engaged in a hole 15*a* of another corresponding slider 15.

Operation of the seesaw type switch of the present invention will be next described below.

FIG. 1 shows a state where a knob 3*a* fixed to the second lever 25 is inclined counterclockwise such that the first lever 22 is in a first pivoted position and the second lever 25 is in a second pivoted position. In this state, the line X—X connecting a support point of the second lever 25, i.e., the central axis of the shaft 26, and the center of the bulged portion 24 at the lower end of the second lever 25 forms an angle in a vertical plane relative to the line Y—Y connecting a support point of the second lever 25, i.e., the central axis of the shaft 26, and the central axis of the driver rod 28. When the knob 3*a* is depressed downward at its right end under the above state to turn the knob 3*a* clockwise, the driver rod 28 is moved to the left over the top surface of the horizontal portion 29 of the first lever 22 and the angle at which the line X—X intersects the line Y—Y is narrowed, as shown in FIG. 2. However, the first lever 22 still remains the same state as FIG. 1. When the knob 3*a* is further turned clockwise from that state, the first and second levers 22, 25 soon pass the so-called dead point at which the line X—X is aligned with the line Y—Y, and the first lever 22 is turned counterclockwise while causing an operator to feel a click, followed by stopping at a position where the horizontal portion 29 of the first lever 22 is abutted at its left end against a frame 4*a* of the case 4 in a second pivoted position, and the second lever 25 is in a fourth pivoted position, as shown in FIG. 3. During the above process, the bulged portion 24 of the first lever 22 engaging the slider 15 is moved to the right and the movable contact 17 is also moved in the same direction over the insulating board 12 to cooperate with the stationary contact 16 for selective breaking or making of the contacts. Additionally, the toggle switch 2 is arranged such that by depressing its knob 2*a*, the lever 7 is turned with the flanged portions 6 of the case 4 serving as a fulcrum and upon the knob 2*a* being released from the depressing force, the resilient force of a torsion coil spring 10 causes the toggle switch 2 to restore to the original rest state.

With the seesaw type switch 3 of the present invention constructed as explained above, as shown in FIG. 4, the opposite shafts 23 of the first lever 22 are rotatably supported by one pair of flanged portions 6 of the case 4 similarly to the lever 7 of the toggle switch 2, and the first lever 22 is brought into a seesaw motion via the driver rod 28 of the second lever 25 of which opposite shafts are rotatably supported on the projecting portion 5*a* of the cover 5 at a level higher than the toggle switch 2. Therefore, even when the distance between the support point of the second lever 25 and the insulating board 12 is as large as conventionally, the amount through which the slider 15 is moved by the first lever 22 upon the seesaw motion of the knob 3*a* can be held the same as the amount through which the slider 15 is moved upon operation of the toggle switch 2.

Furthermore, as shown in FIG. 4, the case 4 is divided into two compartments 4*a*, 4*b* of the same configuration. The opposite shafts 8 of the levers 7 of the two toggle switches 2 are rotatably supported in one compartment 4*a* between respective pairs of the flanged portions 6, while in the other compartment 4*b*, the opposite shafts 8 of the lever 7 of the remaining toggle switch 2 is rotatably supported between one pair of the flanged portions 6 and the opposite shafts 23 of the first lever 22 of the seesaw type switch 3 are rotatably supported between the last pair of the flanged portions 6. Covers 5*b* and 5*c* are fitted over the compartments 4*a*, 4*b*, respectively, such that the two levers 7 are projecting through a hole in the upper surface of one cover 5*c*, and the lever 7 of the remaining toggle switch and the second lever 25 of the seesaw type switch 3 are projecting through a hole in the upper surface of the other cover 5*b*. Then, the opposite shafts 26 of the second lever 25 are rotatably supported by one pair of flanged portions 19 formed on the projecting portion 5*a*. When a power window switch unit 1 is built in the central portion of front seats of a motor vehicle, for example, the seesaw type switch 3 is located at either one of symmetrical positions depending on whether steering wheels of motor vehicles are on the left or right side; i.e., it is located on the left side of the unit 1 for those motor vehicles having steering wheels on the left side, while it is located on the right side of the unit 1 for those motor vehicles having steering wheels on the right side. With the above-mentioned arrangement, even such a modification in assembly can be easily dealt with by changing the position of the seesaw type switch 3 in the case 4*b* and fitting the cover 5*c* over the case 4 after changing an orientation of the cover 5*c* correspondingly, resulting in an advantage of high versatility. Another advantage is that many parts such as the case 4, the slider 15 and the movable contact 17 can be commonly used to achieve improvements in both part management and assembling efficiency, enabling an inexpensive power window switch unit.

As has been described previously, according to the present invention, since the amount through which a slider is moved by a lever upon its seesaw motion can be held small even when the distance from an insulating board to a support point of the lever is set to be relatively large from the standpoint of design, a reduction in the entire switch size is not impeded. Further, when the seesaw type switch of the structure according to the present invention is assembled along with a plurality of toggle switches to constitute one power window switch unit, many parts can be commonly used, thus making it possible to provide the power window switch unit at the reduced cost.

What is claimed is:

1. A seesaw type switch comprising:

a case having a bottom surface;

a stationary contact fixedly connected to said bottom surface;

a movable contact mounted on said bottom surface such that said movable contact is slidable along said bottom surface between and engaged position in which said movable contact electrically connects with said stationary contact, and a disengaged position in which said movable contact is electrically isolated from said stationary contact;

a first lever pivotally supported by said case, said first lever having a top surface and a first protrusion including an end, the end of said first protrusion engaging said movable contact such that when said first lever is in a first pivoted position, said moving contact is in said engaged position, and when said first lever is in a second pivoted position, said moving contact is in said disengaged position;

a cover fixedly connected to said case over said first lever; and a second lever pivotally supported by said cover, said second lever having a second protrusion extending through said cover and engaging said top surface of said first lever such that when said second lever is in a third pivoted position, said first lever is in said first pivoted position, and when said second lever is in a fourth pivoted position, said first lever is in said second pivoted position.

2. The switch of claim 1 wherein said second protrusion defines hollow portion, and said second lever further comprises a spring and a driver rod disposed in said hollow portion, said driver rod being biased against said top surface by said spring.

3. The switch of claim 1 wherein said bottom surface comprises a printed circuit board fixedly connected to said case.

4. The switch of claim 1 further comprising a knob connected to said second lever such that said second lever is manually pivotably between said third pivoted position and said fourth pivoted position.

5. A switch assembly comprising:

a case having a bottom surface;

first and second stationary contacts formed on said bottom surface;

a cover fixedly connected to said case;

a toggle switch pivotably connected to said case, said toggle switch including a first movable contact for contacting said first stationary contact when said toggle switch is pivoted from a resting position, said toggle switch including biasing means for biasing said toggle switch into said resting position; and a seesaw switch comprising:

a second movable contact mounted on said bottom surface such that said second movable contact is slidable along said bottom surface between and engaged position in which said second movable contact electrically connects with said second stationary contact, and a disengaged position in which said second movable contact is electrically isolated from said second stationary contact;

a first lever pivotally supported by said case, said first lever having a top surface and a first protrusion including an end, the end of said first protrusion engaging said second movable contact such that when said first lever is in a first pivoted position, said second moving contact is in said engaged position, and when said first lever is in a second pivoted position, said second moving contact is in said disengaged position; and a second lever pivotally supported by said cover over said first lever, said second lever having a second protrusion extending through said cover and engaging said top surface of said first lever such that when said second lever is in a third pivoted position, said first lever is in said first pivoted position, and when said second lever is in a fourth pivoted position, said first lever is in said second pivoted position.

6. The switch assembly of claim 5 wherein said second protrusion defines hollow portion, and said second lever further comprises a spring and a driver rod disposed in said hollow portion, said driver rod being biased against said top surface by said spring.

7. The switch assembly of claim 5 wherein said bottom surface comprises a printed circuit board fixedly connected to said case.

8. The switch assembly of claim 5 further comprising a knob connected to said second lever such that said second lever is manually pivotably between said third pivoted position and said fourth pivoted position.

* * * * *